US005899509A

United States Patent [19]

Ferguson et al.

[11] Patent Number: 5,899,509

[45] Date of Patent: May 4, 1999

[54] DOOR SECURITY DEVICE HAVING VIEWING POSITION

[76] Inventors: Lee T. Ferguson, 7148 Lantana Ter., Carlsbad, Calif. 92009; Raul A. Castro, 1323 Calle Ultimo, Oceanside, Calif. 92056

[21] Appl. No.: 09/069,699

[22] Filed: Apr. 29, 1998

[51] Int. Cl.[6] ..... E05C 19/18

[52] U.S. Cl. ..... 292/259 R; 292/289; 70/93

[58] Field of Search ..... 292/288, 289, 292/292, 259 R, 262, 265, 268; 70/93

[56] References Cited

U.S. PATENT DOCUMENTS

| | | | |
|---|---|---|---|
| D. 275,550 | 9/1984 | Johnson et al. | D8/331 |
| D. 304,672 | 11/1989 | Pearson | D8/331 |
| 924,277 | 6/1909 | Saphier . | |
| 1,722,736 | 7/1929 | Derbyshire . | |
| 3,167,840 | 2/1965 | Hoffman | 25/131 |
| 3,280,606 | 10/1966 | Howard et al. | 70/91 |
| 3,592,497 | 7/1971 | Logan, Jr. | 292/259 |
| 3,806,179 | 4/1974 | Roessle | 292/259 |
| 3,971,582 | 7/1976 | Walker | 292/268 |
| 3,986,741 | 10/1976 | Giovannini | 292/268 |
| 4,017,104 | 4/1977 | Walker | 292/268 |
| 4,067,598 | 1/1978 | Mansour | 292/259 |
| 4,082,332 | 4/1978 | Palmer | 292/259 |
| 4,119,336 | 10/1978 | Sparrevohn | 292/268 |
| 4,335,910 | 6/1982 | Massie | 292/259 |
| 4,429,911 | 2/1984 | O'Neal et al. | 292/259 |
| 4,462,625 | 7/1984 | Barnhill | 292/259 |
| 4,548,436 | 10/1985 | Cole, Jr. | 292/292 |
| 4,601,503 | 7/1986 | Wicks, Sr. | 292/259 |
| 4,611,680 | 9/1986 | Redenbarger et al. | 180/69.24 |
| 4,852,921 | 8/1989 | Gilbert et al. | 292/259 |
| 5,007,669 | 4/1991 | Pomerleau | 292/262 |
| 5,014,527 | 5/1991 | Traller et al. | 70/94 |
| 5,022,245 | 6/1991 | Jordan et al. | 70/94 |
| 5,026,102 | 6/1991 | Pitman | 292/259 |
| 5,154,461 | 10/1992 | Prescott et al. | 292/346 |
| 5,165,741 | 11/1992 | Everett | 292/259 |
| 5,232,254 | 8/1993 | Teaff | 292/259 |
| 5,340,172 | 8/1994 | Sweet | 292/259 |
| 5,364,140 | 11/1994 | Rice | 292/259 |
| 5,452,929 | 9/1995 | Anderson | 292/288 |
| 5,496,081 | 3/1996 | Rice | 292/259 |
| 5,556,143 | 9/1996 | Robinson | 292/302 |
| 5,580,108 | 12/1996 | Bergstein | 292/259 |
| 5,590,918 | 1/1997 | Kambalov | 292/60 |
| 5,605,364 | 2/1997 | Shelledy | 292/259 |
| 5,622,397 | 4/1997 | Rice et al. | 292/259 |
| 5,638,977 | 6/1997 | Bianchi | 220/314 |
| 5,669,640 | 9/1997 | Ryan | 292/259 |
| 5,669,641 | 9/1997 | Jeansonne | 292/259 |

*Primary Examiner*—Steven Meyers
*Assistant Examiner*—Teri Pham
*Attorney, Agent, or Firm*—Calif Tervo

[57] ABSTRACT

A triple articulating security device for use with a door, such as a house door having a hinged side and a latch (opening) side device holds a door in a closed (security) position or in a partially open (viewing) position. The security device generally comprises a pair of mounting brackets and a bar. The mounting brackets mount, preferably on opposite sides of the door. The bar comprises a viewing portion pivotally mounted to the latch-side bracket, an elongated telescoping portion pivotally mounted to the hinge-side bracket, a pivot pivotally joining their inner ends, a locking mechanism for selectively locking the pivot. The bar is reconfigurable from a securing position, wherein the door is closed and the bar extends substantially linearly between the brackets and the bar prevents the door from opening inward to a viewing position, wherein the viewing portion and the telescoping portion pivot about the pivot such that their inner ends may be swung away from the door such that the door may be partially opened for viewing between the latch edge of the door and the latch side of the frame. A door restraining spacer of adjustable length attached to the viewing portion of the bar spans between the bar and the inner side of the closed door.

11 Claims, 2 Drawing Sheets

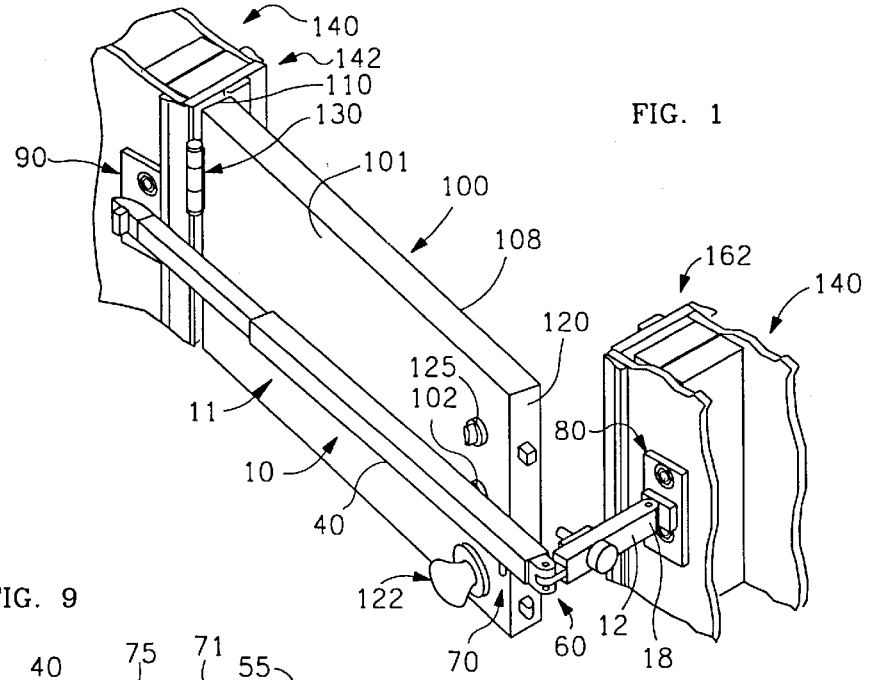
FIG. 1
FIG. 9
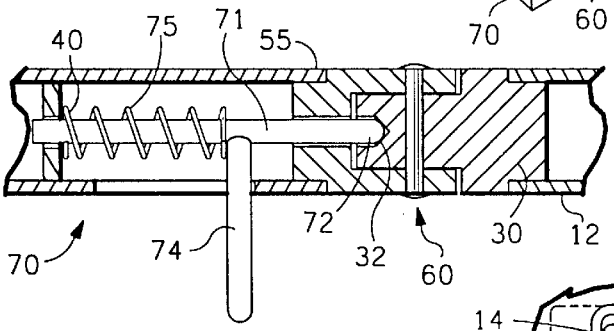
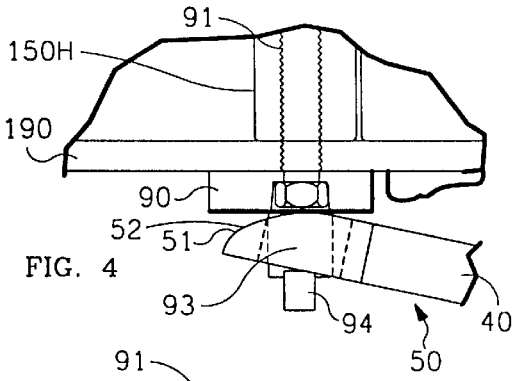
FIG. 4
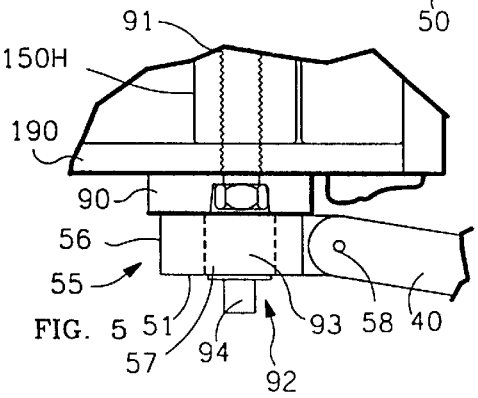
FIG. 5
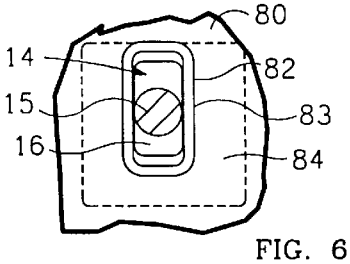
FIG. 6
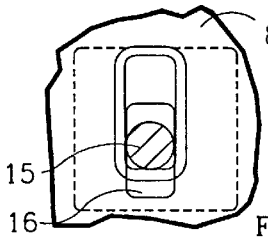
FIG. 7
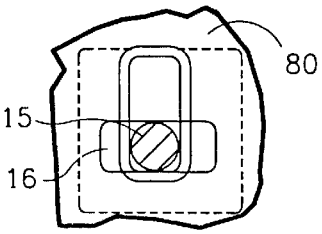
FIG. 8
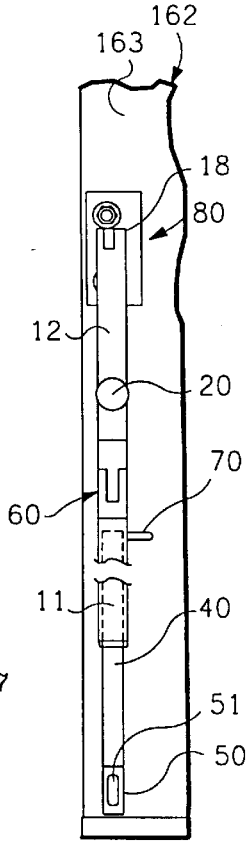
FIG. 12

DOOR SECURITY DEVICE HAVING VIEWING POSITION

BACKGROUND OF THE INVENTION

1. Field of the Invention

This invention relates to a security device for holding a door in a closed (security) position or in a partially open (viewing/inspection) position.

2. Background of the Invention

Security devices to augment the protection afforded by a door are well-known. However, conventional door security devices suffer from one or more deficiencies.

It is desirable that a security device be unobtrusive when not in use. It is desirable that a security device be easily moved from the non-securing to the securing position and vice versa, and that it be easily detachable for storage out of sight. It is desirable that a device in the securing position augment the existing latches to hold the door closed and not merely act as a backup in case of failure of existing latches. It is desirable that a device have a position wherein the door may be partially opened for viewing or for passage of goods. It is desirable that a device in the viewing position be as secure as in the securing position and not be easily broken or removable by an outside person.

Although conventional devices address some of these requirements, none of the conventional devices address all of these requirements. Therefore, there has been a need for a new and improved door security device.

SUMMARY OF THE INVENTION

This invention is a security device for use with a door, such as a house door having a hinged side and a latch (opening) side. The security device holds a door in a closed (security) position or in a partially open (viewing) position. The security device generally comprises a pair of mounting brackets and a bar. The mounting brackets mount, preferably to a wall stud, on opposite sides of the door. The bar comprises a viewing portion, an elongated telescoping portion, a pivot pivotally joining their inner ends, a locking mechanism for selectively locking the pivot, means for pivotally mounting the outer end of the viewing portion on the latch-side bracket and means for pivotally mounting the outer end of the telescoping portion to the hinge-side bracket.

The bar is reconfigurable from a securing position, wherein the door is closed and the bar extends substantially linearly between the brackets and the locking mechanism is in the locking position such that the bar and its door restraint spacer prevents the door from opening inward to a viewing position, wherein the pivot locking mechanism is in a free position whereby the viewing portion and the telescoping portion are pivotable about the pivot such that their inner ends may be swung away from the door such that the door may be partially opened for viewing between the latch edge of the door and the latch side of the frame.

A door restraint spacer of adjustable length attached to the viewing portion of the bar spans between the baS and the inner side of the closed door.

Other features and many attendant advantages of the invention will become more apparent upon a reading of the following detailed description together with the drawings in which like reference numerals refer to like parts throughout.

BRIEF DESCRIPTION OF THE DRAWINGS

FIG. 1 is a perspective view partially cut away of a door hingedly mounted in a frame and a preferred embodiment of the security device of the invention shown mounted to the frame with the bar in viewing/inspection configuration.

FIG. 4 is an enlarged top plan view of the attachment of the outer end of the telescoping portion with the bar in the viewing configuration.

FIG. 5 is an enlarged top plan view similar to FIG. 4 but showing an alternate embodiment of the outer end of the telescoping portion with the bar in the viewing configuration.

FIGS. 6–8 are enlarged front vertical cross-sectional views of the attachment positions of the attachment foot (key) of the outer end of the viewing portion of the bar to the keyway of the bracket.

FIG. 9 is an enlarged front cross-sectional view of a preferred embodiment of the pivot locking mechanism of the bar.

FIG. 12 is a front elevation view of the device in the standby position hanging vertically by the key in the bracket keyway.

DETAILED DESCRIPTION OF THE INVENTION

Figure 10:
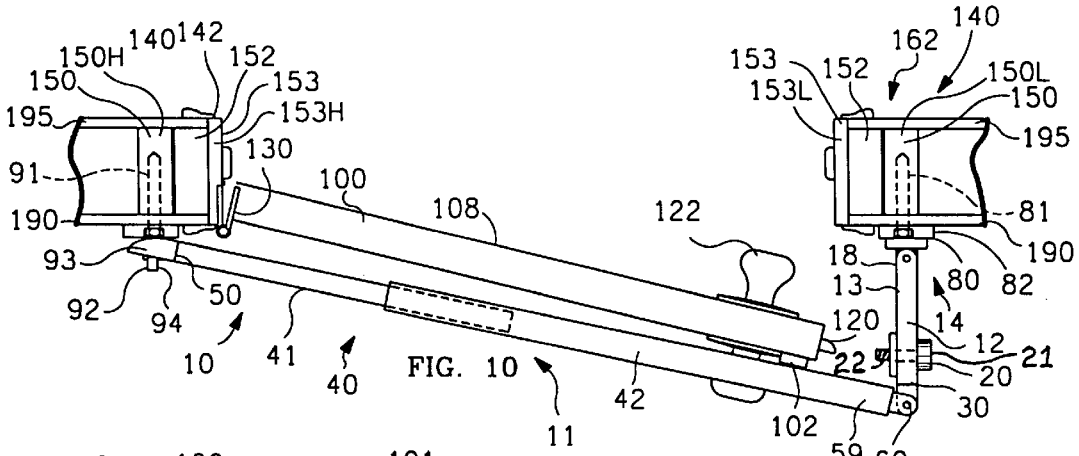
FIG. 10 is a view of the device of FIG. 1.

With reference now to the drawing, FIG. 1 is a perspective view of a preferred embodiment of the security device 10 of the invention shown in the viewing configuration in its environment; showing partially cut away a door, denoted generally as 100 mounted in a frame 140.

Door 100 and frame 140 may be a typical for entry to a home or room. Door 100 includes a hinge edge 110 hingedly mounted, such as by hinge 130, to the hinge side 142 of frame 140, an opposite latch edge 120 which, when door 100 is in a closed position, abuts latch side 162 of frame 140, an inner side 101 and an outer side 108. Latch edge 120 may include a door knob latch assembly 122 and/or a deadbolt latch assembly 125.

Security device 10 includes, in general, a latch-side bracket 80, a hinge-side bracket 90, and a bar 11 mounted between the brackets 80,90 including a viewing portion 12, an elongated telescoping portion 40, a pivot 60 pivotally joining viewing portion 12 and telescoping portion 40 and a locking mechanism 70 for pivot 60. These elements will be further explained in greater detail.

Figure 2:
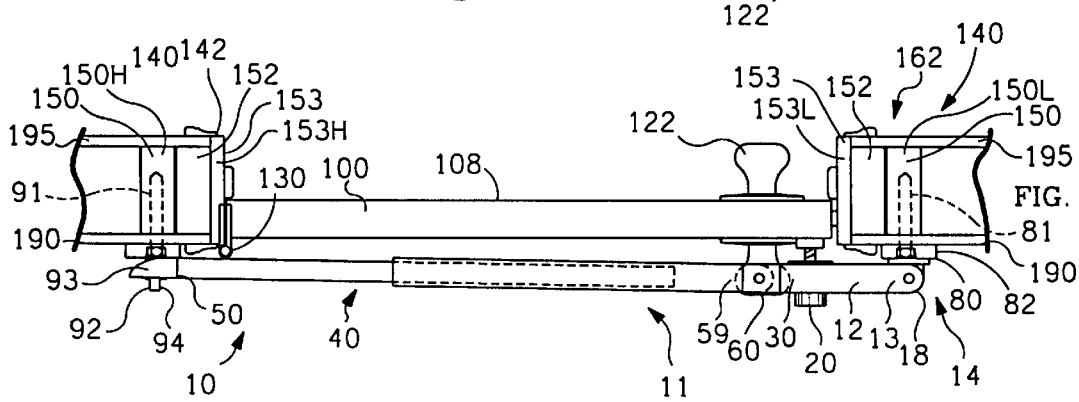
FIG. 2 is top view of the device of FIG. 1 with the bar in the securing configuration.
Figure 3:
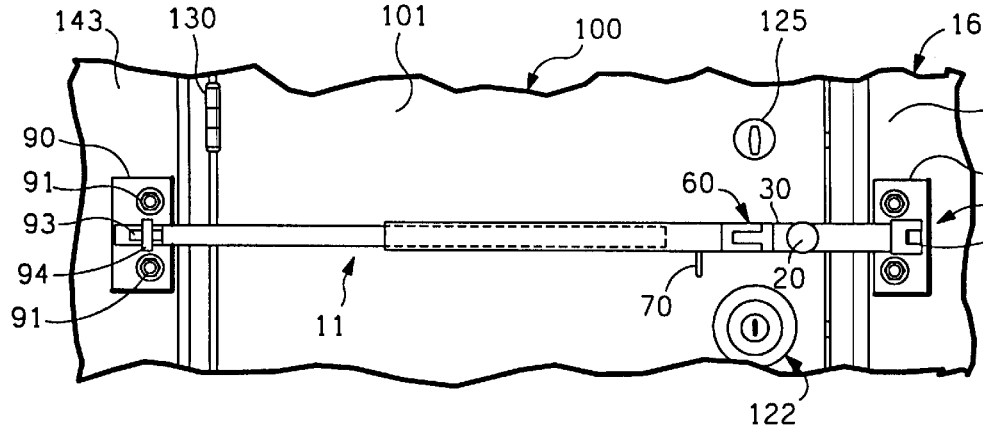
FIG. 3 is front elevation view of the device of FIG. 2.

Turning now to FIGS. 2 and 3, FIG. 2 is top view of security device 10 of FIG. 1 with bar 11 in the securing configuration holding door 100 closed and FIG. 3 is front elevation view of FIG. 2.

Frame 140 includes king or wall or studs 150, such as hinge-side wall stud 150H and latch-side wall stud 150L, latch- and hinge-side trimmers 152, jams 153, such as hinge jam 153H and latch jam 153L, inside wall 190 and outside wall 195. Wall studs 150 are typically the strongest structural members of frame 140 in that they have a bottom end fastened to the sole plate and a top end fastened to the top plate of the wall structure.

Hinge-side bracket 90 is preferably made of strong metal and is securely mounted to inner side 143 of hinge side 142 of frame 140, preferably to wall stud 150H with fastening means, such as large screws, such as lag screws 91. Hinge-side bracket 90 and outer end 50 of telescoping portion 40 include means for attaching outer end 50 to bracket 90 and for allowing all or most of telescoping portion 40 to pivot relative to the attachment. There are many ways to accomplish this, however two preferred methods are shown.

Turning momentarily to FIG. 4, there is shown an enlarged top plan view of bracket 90 and the attachment of the outer end 50 of telescoping portion 40 of bar 1i. Bracket 90 includes means, such as locking post 92, for mounting bar 11. In the embodiment shown, mounting post 92 is of standard construction including a projection 93 of rectangular cross-section and a rotating locking head 94. Outer end 50 of telescoping portion 40 includes a through bore 51 which is placed on projection 93 and the locking head 94 is rotated to retain outer end 50. Through bore 57 is longitudinally longer than projection 93 and the bracket-facing side 52 of outer end 50 is radiused whereby sufficient pivoting movement is provided for rotation of telescoping member 40 to the viewing configuration.

FIG. 5 shows another means for pivotally mounting outer end 50 of telescoping portion to hinge-side bracket 90. An attachment section 56 is pivotally attached, such as by pivot pin 58 to outer end 50 of telescoping portion 40. Attachment section 56 includes a through bore 57 which is placed on projection 93 and the locking head 94 is rotated to retain outer end 50.

Latch-side bracket 80 is preferably made of strong metal and is securely mounted to inner side 163 of latch side 162 of frame 140, preferably to wall stud 150L with fastening means, such as large screws 81. Latch-side bracket 80 and outer end 13 of viewing portion 12 include means for attaching outer end 13 to bracket 80 and for allowing all or most of viewing portion 40 to pivot relative to the attachment. There are many ways to accomplish this, however a preferred means is shown. Latch-side bracket 80 includes means, such as retaining cavity 82, for mounting bar 11. Turning momentarily to FIGS. 6–8, there are shown enlarged partial front views of latch-side bracket 80 and retaining cavity 82. Retaining cavity 82 includes an entrance orifice 83 to a larger internal cavity 84. Attached to outer end 13 of viewing portion 12 of bar 11 is attachment means 14 for attachment to bracket 80. Attachment means 14 includes foot 16 connected by shaft 15, shown in cross-section, to the remainder of viewing portion 12. FIG. 6 shows foot 16 entering orifice 83. FIG. 8 shows shaft 15 and foot 16 rotated such that foot 16 is retained in cavity 84 and retains bar 11. It is important to note that the attachment requires rotating bar 11 about its longitudinal axis.

Returning to FIGS. 2 and 3, attachment means 14 includes a pivot 18 pivotally mounting outer end 13 of viewing portion. Bar 11 is shown mounted to brackets 80,90 and extending substantially linearly therebetween. A pivot 60 pivotally joins the inner end 30 of viewing portion 12 and the inner end 59 of telescoping portion 40 such that they may pivot in a plane perpendicular to door 100 which would ordinarily be a horizontal plane.

A locking mechanism 70 for pivot 60 is selectively moveable between a locking position and a free position. FIG. 9 is an enlarged front cross-sectional view of a preferred embodiment of the pivot locking mechanism 70 which is housed in inner end 59 of telescoping portion 40. Pivot locking mechanism 70 includes a locking pin 71 supported for longitudinal movement and biased by spring 75 toward the locking position, shown, wherein the pin tip 72 is disposed in a bore 32 in inner end 30 of viewing portion 12 whereby portions 12, 40 may not pivot about pivot 60. A handle 74 connected to pin 71 is moved away from pivot 60 to move pin 71 to the free position with its tip 72 out of bore 32 such that it does not lock pivot 60. Other locking mechanisms are envisaged. For example, a sliding collar on bar 11 could be used to encircle the area of pivot 60 and thereby prevent its movement.

A door retaining spacer 20 protrudes from bar 11, preferably from viewing portion 12, in the securing position for spanning between viewing portion 12 and inner side 101 of door 100. In the preferred embodiment, door retaining spacer 20 is rigid such that the closed door 100 cannot move toward bar 11. Door retaining spacer 20 comprises a knob 21 for turning a threaded shaft 22 the terminus of which contacts inner side 101 of door 100. The length of door retaining spacer 20 is adjustable by turning knob 21 to change the length of shaft 22 between bar 11 and door 100. Preferably door retaining spacer 20 is rigid. Door retaining spacer 20 contributes greatly to the strength of the system in that security device 10 is simultaneously added to the strength of the standard latches 122, 125 to prevent entry. Door retaining spacer 20 prevents the securing members from being broken one at a time. Preferably an impact plate 102 is placed on inner side 101 of door 100 to receive the spacer shaft 22 to spread out the load area on door 100 or alternatively the terminus of shaft 22 can be enlarged as desired.

Figure 11:
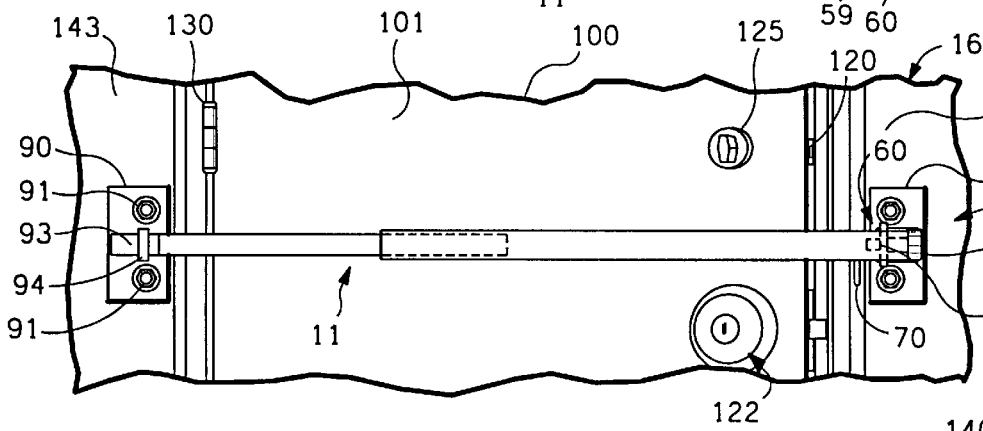
FIG. 11 is front elevation view of the device of FIG. 10.

Returning once more to FIG. 1 and further including FIGS. 10 and 11, security device 10 is shown in the viewing configuration. FIG. 10 is a top view of device 10 and environment of FIG. 1, and FIG. 11 is front elevation view thereof. Bar 11 is reconfigurable from the securing position shown in FIGS. 2 and 3 to the viewing position by moving locking mechanism 70 to the free position thereby allowing pivot 60 to pivot. This is done by moving locking handle 74 to withdraw pin 71 from engagement with locking bore 32 in inner end 30 of viewing portion 12.

With pivot 60 free to pivot, viewing portion 12 and telescoping portion 40 are pivotable about pivot 60 such that their inner ends 30, 59 may be swung away from door 100. In moving pivot 60 away from door 100, first and second members 41, 42 of telescoping portion 40 move longitudinally relative to one another to lengthen bar 11 and telescoping portion 40 and viewing portion 11 pivot about their outer ends 13,50. Door 100 now may be partially opened for viewing between its latch edge 120 and latch side 162 of frame 140. Impact plate 102 contacts telescoping portion 40. A stop prevents telescoping member 41, 42 from disengagement with one another. In the viewing position, a person inside may talk with a person outside and mail, food or other materials may be passed through but the opening is too small for a person to pass.

FIG. 12 is a front elevation view of the device in the standby position hanging from latch-side bracket 80 such as to not block door 100. FIG. 7 illustrates the standby position of shaft 15 and foot 16 in retaining cavity 82 of latch-side bracket 80. Moving bar 11 from the standby position of FIG. 12 to the securing position of FIG. 3 is a simple matter of swinging outer end 50 up and attaching it to hinge-side bracket 90 whereby shaft 15 and foot 16 rotate to the locked position shown in FIG. 8.

It is now seen that bar 11, in the securing configuration or in the viewing configuration, cannot be removed without first detaching outer end 50 of telescoping member 40. With bar 11 in the securing configuration or in the viewing configuration, a person outside door 100 cannot access outer end 50 and therefore cannot remove bar 11 and gain entry. Preferably, device 10 is made of strong material, such as steel.

Having described the invention, it can be seen that it provides a very convenient device for preventing unwanted entry and for viewing in security. It hangs unobtrusively vertically from latch-side bracket when not in use and is easily removed and stored out of sight. It is easily moved from the non-securing to the securing position and vice versa by simple attachment to hinge-side bracket. In the securing position it augments the existing latches to hold the door tightly closed and does not merely act as a backup in case of failure of existing latches. It has a viewing position wherein the door may be partially opened for viewing or for passage of goods. In the viewing position it is not easily broken or removable by an outside person.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A security device for use with a door mounted in a frame, the frame having a hinge side having an inner side and having a latch side having an inner side, and the door having an inner side, a hinge edge hingedly mounted to the hinge side of the frame and an opposite latch edge which, when the door is in a closed position, abuts the latch side of the frame; said security device comprising:

a bar including:

a viewing portion having:

an outer end; and an inner end;

an elongated telescoping portion having:

at least two members, one member being longitudinally movable with respect to the other;

an outer end; and an inner end;

a pivot pivotally joining said inner end of said viewing portion and said inner end of said telescoping portion; and a locking mechanism for said pivot; said locking mechanism selectively moveable between a locking position and a free position;

a latch-side bracket adapted to be mounted to the inner side of the latch side of the frame;

viewing portion pivotally mounting means for pivotally mounting said outer end of said viewing portion on said latch-side bracket;

a hinge-side bracket adapted to be mounted to the inner side of the hinge side of the frame; and telescoping portion pivotally mounting means for pivotally mounting said outer end of said telescoping portion to said hinge-side bracket;

wherein, said bar is reconfigurable from a securing position, wherein the door is closed, said bar extends substantially linearly between said brackets and said locking mechanism is in the locking position whereby said viewing portion and said telescoping portion may not pivot about said pivot so as to be swing away from the door and said bar prevents the door from opening inward to a viewing position, wherein said locking mechanism is in the free position whereby said viewing portion and said telescoping portion are pivotable about said pivot such that said inner ends may be swung away from the door such that the door may be partially opened for viewing between the latch edge of the door and the latch side of the frame.

2. The device of claim 1 further including:

a door restraining spacer attached to said bar; said door restraining spacer adapted to span between said bar and the inner side of the closed door.

3. The device of claim 2 further including:

means for adjusting the spanning length of said door restraining spacer.

4. The device of claim 3 wherein:

said door restraining spacer is attached to said viewing portion.

5. The device of claim 2 wherein:

said door restraining spacer is attached to said viewing portion.

6. The device of claim 1 wherein said viewing portion pivotally mounting means includes:

attachment means for attachment to said latch-side bracket; and a pivot attaching said attachment means to said outer end of said viewing portion.

7. The device of claim 6 wherein said attachment means includes a fastener that requires engagement with said latch-side bracket and then turning of said bar about its longitudinal axis thereby locking said bar in the security configuration or the viewing configuration to said latch-side bracket.

8. The device of claim 1 wherein said locking mechanism includes:

a longitudinally moveable locking member mounted to a portion of said door and selectably engageable with the other said portion such that said portions cannot pivot about said pivot.

9. The device of claim 1 wherein said telescoping portion pivotally mounting means includes:

attachment means for attachment to said hinge-side bracket; and a pivot attaching said attachment means to said outer end of said telescoping portion.

10. The device of claim 9 wherein said attachment means of telescoping portion pivotally mounting means includes:

an attachment section including a through bore for attachment to hinge-side bracket; and a pivot pivotally attaching said attachment section to said outer end of said telescoping portion.

11. The device of claim 1 wherein said telescoping portion pivotally mounting means includes:

attachment section rigidly attached to said telescoping portion; said attachment section including:

a through bore for attachment to a post on said hinge-side bracket; and a bracket-facing side radiused such that sufficient pivoting movement is provided for rotation of telescoping member to the viewing configuration.

* * * * *